US005218734A

United States Patent [19]

Sacks

[11] Patent Number: 5,218,734

[45] Date of Patent: Jun. 15, 1993

[54] COLLAPSIBLE CLEANING IMPLEMENT

[75] Inventor: Dieter Sacks, Jona, Switzerland

[73] Assignee: EWU AG, Jona, Switzerland

[21] Appl. No.: 683,427

[22] Filed: Apr. 9, 1991

[30] Foreign Application Priority Data

Apr. 11, 1990 [DE] Fed. Rep. of Germany ..... 4011713

[51] Int. Cl.[5] ..... A47L 13/24

[52] U.S. Cl. ..... 15/147.2; 15/147.1; 15/228

[58] Field of Search ..... 15/147 R, 147 A, 147 B, 15/147 C, 149, 154, 228, 229.1-229.9

[56] References Cited

U.S. PATENT DOCUMENTS

| | | | |
|---|---|---|---|
| 1,256,989 | 2/1918 | Duncan | 15/228 |
| 1,344,936 | 6/1920 | Beaudet | 15/228 |
| 2,840,840 | 7/1958 | Yamen | 15/147 R |
| 3,005,220 | 9/1961 | McPherson | 15/147 A |
| 3,324,495 | 6/1967 | Schwartz | 15/147 A |
| 3,405,418 | 10/1968 | Carter et al. | 15/147 R |
| 3,458,886 | 8/1969 | Goettel | 15/147 R |
| 4,663,798 | 5/1987 | Sacks | 15/261 |
| 4,704,763 | 11/1987 | Sacks | 15/262 |
| 4,783,873 | 11/1988 | Young | 15/147 A |
| 4,799,283 | 1/1989 | Haydon | 15/229 |
| 4,843,674 | 7/1989 | Jones | 15/147 R |
| 4,881,290 | 11/1989 | Bohacek | 15/147 A |

FOREIGN PATENT DOCUMENTS 2206037 12/1988 United Kingdom ..... 15/228

*Primary Examiner*—Harvey C. Hornsby
*Assistant Examiner*—Patrick F. Brinson
*Attorney, Agent, or Firm*—Peter K. Kontler

[57] ABSTRACT

A mop wherein the plate-like carrier for a mophead has a centrally located plate-like support which overlaps the upper sides of inner portions of two plate-like sections having outer portions with devices for releasably clamping flaps at the ends of a mophead. The sections of the carrier are held in operative positions (in which their undersides are substantially coplanar and the median portion of the mophead is stretched along the undersides of the sections) by a single locking bolt which is reciprocable in a guide at the upper side of the support. The guide defines a pivot axis for the lower end of a handle, and the sections are pivotable about two neighboring axes which are normal to the pivot axis for the handle. The locking bolt can be released by a single pivotable pedal for automatic movement to an inoperative position in which the undersides of the sections are adjacent each other and the median portion of the mophead forms a downwardly extending loop which can be cleaned in a relatively small body of cleaning liquid in a bucket. The locking bolt is automatically returned to its operative position when the sections of the carrier are pivoted back to their starting positions in which the mophead is stretched and is adjacent their undersides.

23 Claims, 4 Drawing Sheets

COLLAPSIBLE CLEANING IMPLEMENT

BACKGROUND OF THE INVENTION

The invention relates to cleaning implements in general, and more particularly to improvements in cleaning implements of the type known as mops. Still more particularly, the invention relates to improvements in cleaning implements of the type wherein the carrier for the mophead is collapsible.

It is already known to provide a cleaning implement, which employs a detachable mophead, with a carrier comprising two plate-like sections. The sections are pivotable between first positions in which their undersides are substantially coplanar and second positions in which their undersides confront each other. The upper side of the carrier pivotally supports one end of an elongated handle, and the mophead is releasably connected to the outer portions of the sections so that it can be caused to hang downwardly beyond the sections in the second positions of such sections and to be more readily introduced into a supply of cleaning liquid or into a suitable wringer.

Conventional cleaning implements of the above outlined character are provided with locking devices which can releasably hold the sections of the mophead carrier in their first or operative positions. The arrangement is such that the locking devices are engaged or activated in response to exertion of requisite pressure upon the handle in a direction toward the upper side of the carrier while the mophead lies on the floor or on another support. The locking devices for both sections of the mophead carrier can be disengaged or deactivated in response to an abrupt pull upon the handle or by pulling the handle while a foot presses the section to be unlocked against the floor.

It has been found that the above described manipulation of a cleaning implement with a collapsible mophead carrier is rather cumbersome, at least under certain circumstances. For example, the locking device for the one and/or the other section of the carrier can be released or disengaged when the implement is caused to strike an elevation in the floor which is to be cleaned, e.g., when the carrier strikes a stair. Thus, the operator in charge of manipulating a conventional mop must be on the alert at all times in order to immediately ascertain whether or not the one or the other section of the mophead carrier has become unlocked and is free to leave its operative position. This, in turn, interferes with the cleaning operation and renders such operation more cumbersome because the operator must prevent the mop from striking an obstruction on the floor and must be more careful just because the locking devices for the pivotable sections are likely to become deactivated at an inopportune time. Each unintentional deactivation of a locking device necessitates an interruption of the cleaning operation which is particularly undesirable when a mop is used to clean a relatively large surface and the operator is expected to complete the cleaning operation within a certain interval of time.

Proposals to enhance the locking action of heretofore known locking devices have met with limited success The locking force cannot be increased at will because this would necessitate a corresponding increase of the unlocking force. The unlocking force must be applied at certain intervals in order to replace a damaged (particularly worn) mophead or to collapse the u carrier in order to permit thorough cleaning and subsequent wringing of the mophead. Moreover, if the implement is used to sweep solid impurities, the need for an increased pull in order to unlock the devices which hold the sections of the carrier in operative positions is likely to cause the accumulated solid impurities to fall off the mophead.

A somewhat greater locking force can be applied if the locking devices for the sections of the mophead carrier are disengaged one after the other. This involves the pressing of one section against the floor while the handle is pulled upwardly and away from the floor, and thereupon holding the other section against the floor while the pulling action upon the handle is repeated. This is a time-consuming operation which can affect the output of the user of such cleaning implement.

Certain presently known proposals to attach the mophead to the carrier include the provision of means for connecting the mophead in such a way that it is located between the confronting undersides of the sections when the sections are caused or permitted to assume their second positions. Thus, the sections are supposed to act not unlike a wringer which is to expel moisture from the mophead between them. A drawback of such proposal is that the sections are likely to cause deeper penetration of collected impurities into and between the strands of the mophead.

It was further proposed to attach the mophead only to the outer end portions of the sections so that the mophead sags when the sections are caused or permitted to move to the second positions. This simplifies the cleaning operation and reduces the likelihood of retention of collected impurities in the mophead. However, the median portion of the mop must be separated from adjacent portions of the undersides of the sections by hand which is a time-consuming and unsanitary operation. Moreover, the operator must bend in order to reach the undersides of the sections and the median portion of the mophead.

A cleaning implement of the class to which the present invention pertains is disclosed, for example, in U.S. Pat. No. 4,799,283 granted Jan. 24, 1989 to Haydon.

OBJECTS OF THE INVENTION

An object of the invention is to provide a cleaning implement which can be collapsed and erected in a simple and time saving manner.

Another object of the invention is to provide a cleaning implement wherein both sections of the carrier for a mophead can be released for movement to their collapsed or inoperative positions in response to the actuation of a single releasing device.

A further object of the invention is to provide a novel and improved carrier for the mophead of a collapsible cleaning implement.

An additional object of the invention is to provide a cleaning implement which is less likely to accidentally release the sections of the mophead carrier than heretofore known cleaning implements.

Still another object of the invention is to provide a cleaning implement with an novel and improved locking device for the pivotable sections of the mophead carrier.

A further object of the invention is to provide the cleaning implement with novel and improved means for releasably locking the mophead to its carrier.

Another object of the invention is to provide the cleaning implement with novel and improved means for preventing stray movements of the mophead relative to its carrier.

An additional object of the invention is to provide the cleaning implement with novel and improved means for automatically promoting the movement of at least one section of the mophead carrier to its inoperative position as soon as the locking device is actuated to permit the sections of the carrier to leave their operative positions.

A further object of the invention is to provide the cleaning implement with novel and improved means for automatically activating the locking device in response to movement of the sections of the mophead carrier toward their operative positions.

Another object of the invention is to provide a cleaning implement wherein the parts which are likely to collect contaminants are readily accessible for inspection and/or cleaning.

A further object of the invention is to provide the cleaning implement with novel and improved means for activating the locking means for the sections of the mophead carrier.

An additional object of the invention is to provide a cleaning implement wherein the sections of the carrier for the mophead can be properly manipulated without bending by the operator and wherein the handle need not be pulled or pushed with a large force for the purpose of facilitating cleaning of the mophead and/or for the purpose of connecting the mophead to or disconnecting the mophead from its carrier.

Another object of the invention is to provide a cleaning implement of the type known as a mop wherein the sections of the mophead carrier can be moved to operative or inoperative positions with little loss in time and wherein such sections are less likely to be automatically released for movement to inoperative positions than in heretofore known cleaning implements.

A further object of the invention is to provide a cleaning implement wherein a mophead carrier which happens to strike a stair or another elevation on the surface to be cleaned is less likely to release its sections for movement to inoperative positions than in heretofore known cleaning implements.

An additional object of the invention is to provide a cleaning implement wherein the sections of the mophead carrier can be released for movement to inoperative positions in response to the exertion of a relatively small force.

Another object of the invention is to provide a cleaning implement wherein the mophead is automatically caused to assume an optimum position for inspection, cleaning and/or wringing as soon as the sections of the carrier are permitted to assume their inoperative positions.

A further object of the invention is to provide a cleaning implement wherein the mophead can be rapidly detached from or attached to its carrier.

Another object of the invention is to provide a cleaning implement wherein a mophead can be reliably fixed to the sections of the carrier by relatively simple, compact and inexpensive connecting means.

Still another object of the invention is to provide a novel and improved method of manipulating the above outlined collapsible cleaning implement.

A further object of the invention is to provide a novel and improved method of releasably securing selected portions of a mophead to its carrier, particularly to a collapsible carrier.

SUMMARY OF THE INVENTION

The invention is embodied in a collapsible cleaning implement of the type commonly known as a mop. The improved cleaning implement comprises a substantially plate-like mophead carrier including first and second sections or panels each having an upper side and an underside (reference is being had to the positions of the sections when the implement is in actual use to sweep floors or other relatively large areas). The sections are pivotable relative to each other between first or operative positions in which the undersides of the two sections are substantially coplanar and second positions in which the undersides confront each other. The implement further comprises a preferably elongated stick-shaped handle, means for movably coupling one end of the handle to the carrier at the upper sides of the sections, and means for releasably locking the sections in the first positions. The locking means comprises a locking device which is actuatable to release the sections for movement from the first positions, and a single actuator for the locking device.

The carrier preferably further comprises a support for the coupling means and hinges which pivotally connect the support with the two sections so that the sections can turn relative to each other and relative to the support about two preferably parallel and slightly spaced-apart axes. The locking device is preferably mounted on the support and the support overlies portions of the upper sides of the two sections in the first positions of the sections.

In a presently preferred embodiment, the locking device comprises an elongated bolt which is reciprocable along a predetermined path substantially transversely of the pivot axes for the sections. The bolt has first and second end portions, and the locking device further comprises first and second sockets which are provided at the upper sides of the first and second sections and are preferably spaced apart form the hinges. The bolt is movable between an operative position in which its end portions are received in the respective sockets (in the first positions of the sections) and an inoperative position in which at least one of the end portions is withdrawn from the respective socket. The support preferably comprises a guide (e.g., an elongated trough or sleeve) for the reciprocable locking bolt. The guide can form part of the coupling means and can define for the handle a pivot axis which is substantially normal to the pivot axes for the sections.

The locking device preferably further comprises means for biasing the locking bolt to the inoperative position, means for blocking the movement of the locking bolt beyond the inoperative position under the action of the biasing means, and means for locating the locking bolt in the operative position against the opposition of the biasing means. The latter can comprise a helical spring. At least one end portion of the locking bolt preferably extends beyond the guide in the inoperative position of the locking bolt.

The actuator can include a holder (e.g., a lever) for one of the sockets. The holder is movable relative to the respective section (at the one socket) between a retaining position in which the one socket is free to receive the respective end portion of the locking bolt and a releasing position in which the one socket is outside of the path of movement of the respective end portion. The actuator can comprise means (e.g., a leaf spring which is integral with the holder) for yieldably urging the holder to the retaining position. The aforedescribed locking device can further comprise means moving the locking bolt from the inoperative position in response to pivoting of the section for the holder to the first position. The moving means can comprise a cam face confronting the upper side of the section for the holder and provided on that end portion of the locking bolt which is receivable in the one socket. The holder can include a claw or jaw which forms part of or constitutes the one socket, an arm which is adjacent the claw, and means for pivotally securing the holder to the respective section. The claw engages the cam face to move the locking bolt from the inoperative position in response to pivoting of the section for the holder to its first position. The claw is preferably disposed between the one end portion of the locking bolt and the arm of the holder, and the securing means is preferably spaced apart from the claw and can include a hinge which is recessed into the upper side of the respective section.

The design of the locking means can be such that the sockets at the upper sides of the sections are at least closely adjacent (e.g., immediately adjacent) the support of the carrier in the first positions of the sections. Each socket can include a hood which overlies the respective end portion of the locking bolt in the first positions of the sections. As mentioned above, one of the sockets can be provided on and can form part of the actuator.

The actuator can include or constitute a pivotable pedal. The aforementioned arm of the holder of the actuator can be provided with a platform which is depressible by a finger, by a foot or by an implement to thus permit movement of the locking bolt to the inoperative position. The actuator can also comprise means (e.g., an integral leaf spring of the holder) for yieldably urging the pedal to the retaining position, and means for pivoting the one section from the first position in response to pivoting of the pedal from the retaining to the releasing position; such pivoting means can comprise a leaf spring which can be an integral part of the holder.

The distance between the pivot axes for the sections of the carrier can exceed the thickness of a section; for example, such distance can equal or approximate the combined thickness of both sections.

The sections comprise neighboring inner portions at the respective pivot axes and outer portions which are remote from each other in the first positions but are adjacent each other in the second positions of the sections. The mophead is disposed at the undersides of the sections, and the implement preferably further comprises means for separably connecting the mophead to the outer portions of the sections. The underside of at least one section can include means for opposing movements of the mophead and the sections relative to each other in the general direction of the pivot axes for the sections in the first positions of the sections. Such opposing means can comprise unevennesses which are provided at the underside of the at least one section. The unevennesses can comprise elongated ribs which extend substantially transversely of the pivot axes for the sections and can be located at or close to the central region of the underside of the at least one section.

The connecting means preferably comprises pivotable yokes at the outer portions of the sections. Each yoke is or can be substantially U-shaped and includes a mophead-engaging web and two legs which are pivoted to the outer portion of the respective section. To this end, the free ends of the legs can be provided with preferably inwardly extending stubs and the outer portions of the sections are provided with aligned bearings for the stubs of legs forming part of the respective yokes. The upper sides of the outer portions of the sections can be provided with recesses, and the yokes are pivotable between mophead-retaining positions in the respective recesses and mophead-releasing positions outside of the respective recesses. The recesses are preferably provided in the marginal zones of the respective outer portions, and each recess can be designed to snugly receive the respective yoke in the mophead-retaining position.

The webs of the yokes can be provided with elongated slots, and the upper sides of the outer portions are then provided with projections (e.g., in the form of elongated ribs) which are substantially complementary to the respective slots. The projections extend into the respective slots to clamp a portion of a mophead which is caused to overlie the respective projection. The slots are remote from the respective projections in the releasing positions of the yokes to permit detachment of the mophead from the outer portions of the sections. The projections and the slots are or can be at least substantially parallel to the pivot axes for the sections.

The upper sides of outer portions of the sections can be provided with shoulders which are preferably located in the respective recesses and can be frictionally engaged by the inner sides of the respective webs when the yokes are pivoted to their retaining positions.

The legs of the yokes and the respective outer portions can be provided with complementary male and female positioning elements serving to prevent movements of the legs away from each other or toward each other. The male positioning elements are received in the respective female positioning elements in the retaining positions of the respective yokes, and the male positioning elements are remote from the respective female positioning elements in the releasing positions of the yokes.

Means can be provided for releasably arresting the yokes in the retaining positions. Such arresting means can include rotary knobs at the upper sides of outer portions of the sections.

The support of the carrier can have an open underside to afford access to the coupling means between the two sections.

The novel features which are considered as characteristic of the invention are set forth in particular in the appended claims. The improved cleaning implement itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
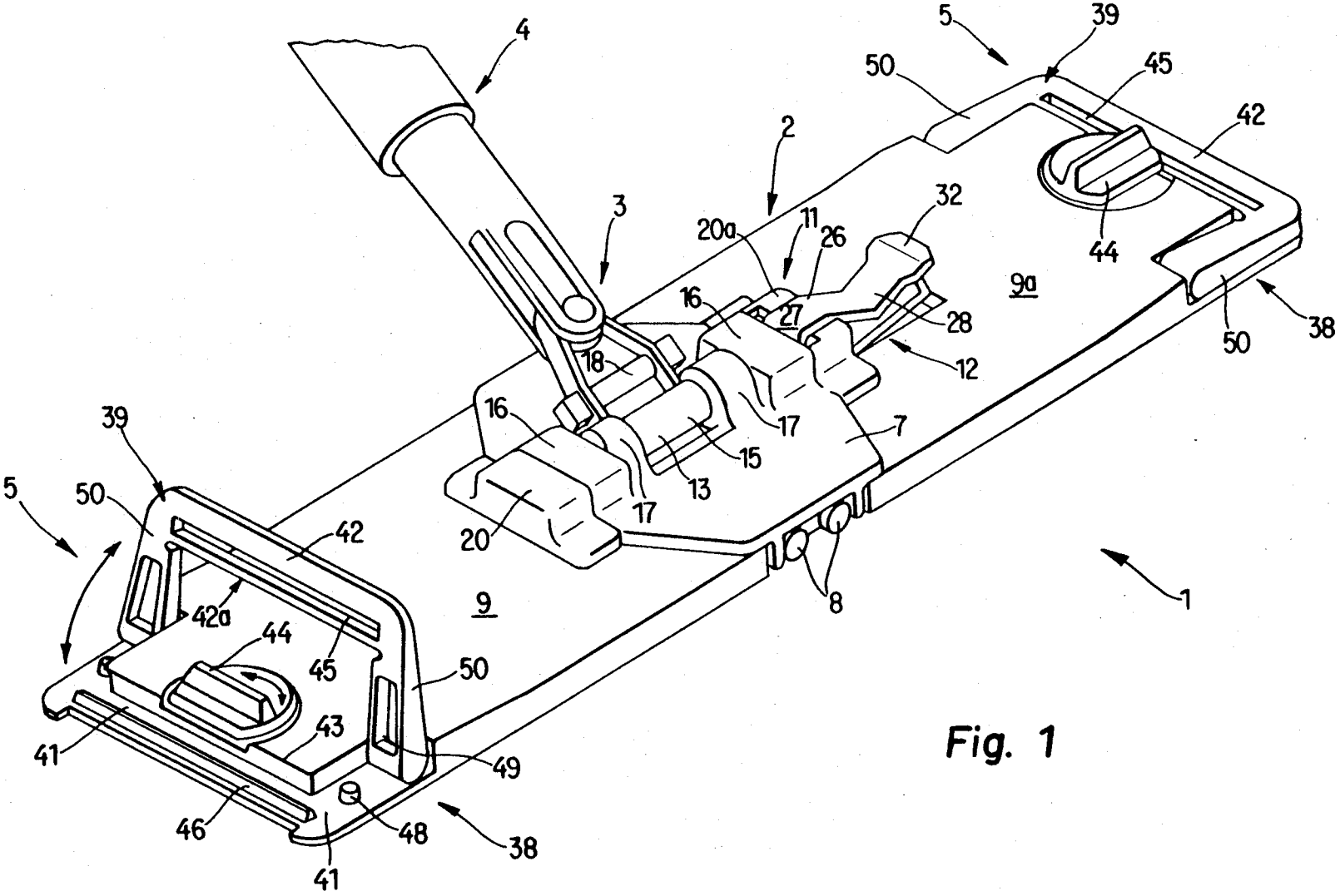
FIG. 1 is a perspective view of a collapsible cleaning implement which embodies one form of the invention, the plate-like sections of the carrier for the mophead being shown in their first or operative positions and one yoke of the means for separably connecting the mophead to the sections being shown in the releasing position, the mophead being omitted for the sake of clarity.
Figure 6:
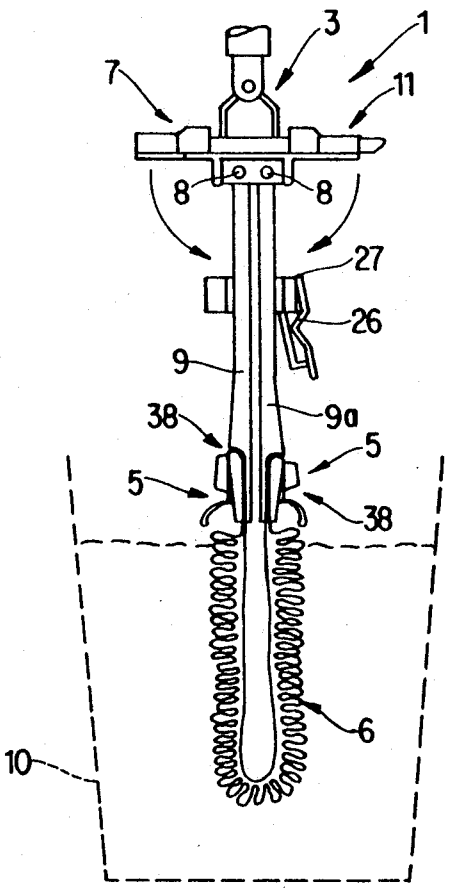
FIG. 6 is a side elevational view of the cleaning implement with the sections moved to their second positions and with the central portion of the mophead immersed into a supply of cleaning liquid in a vessel which is indicated by broken lines.
Figure 5:
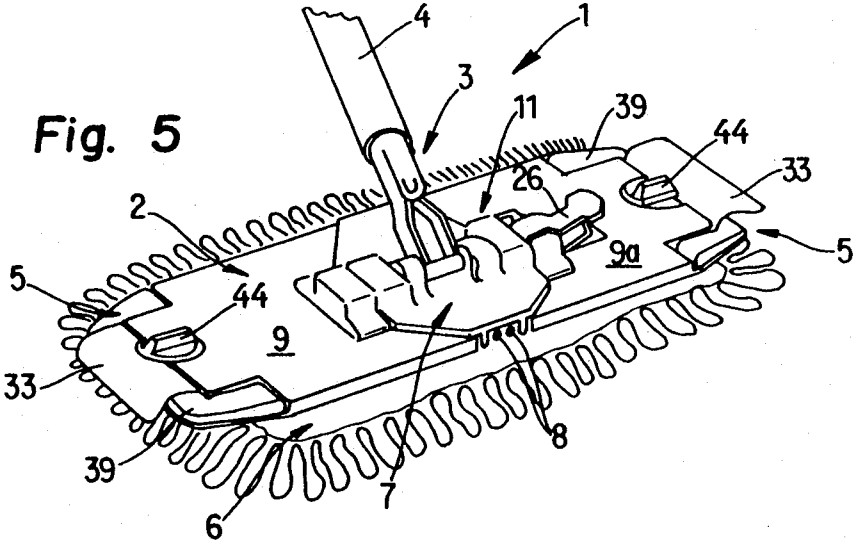
FIG. 5 is a smaller-scale perspective view of the cleaning implement, with a portion of the handle broken away and with the mophead connected to the outer portions of the sections.

Referring first to FIGS. 1, 5 and 6, there is shown a collapsible cleaning implement 1 (hereinafter called mop for short) which comprises a substantially rectangular elongated plate-like carrier 2 for a mophead 6, a handle 4, a means 3 for pivotably coupling one end portion of the handle 4 to the carrier 2. The mophead 6 is positively but separably connected only to the outer portions 5 of two plate-like sections or panels 9, 9*a* of the carrier 2 in such a way that the median portion of the mophead 6 hangs downwardly in the form of a loop (FIG. 6) when the sections 9, 9*a* are permitted to move from their first or operative positions (in which their undersides are disposed in or close to a common plane) to their second or inoperative positions which are shown in FIG. 6 and in which their undersides are adjacent and confront each other.

The carrier 2 further comprises a central section or support 7 which mounts the coupling means 3 for the handle 4 and which further carries two hinges including parallel pintles 8 serving to pivotally connect the sections 9, 9*a* to the support 7. The support overlies the adjacent portions of the upper sides of sections 9, 9*a* when the mop 1 is ready for use, i.e., when the undersides of the sections 9, 9*a* are substantially coplanar and the mophead 6 is stretched to overlie the undersides of both sections. The axes of the two sets of pintles 8 are parallel to each other, and the distance between such axes preferably exceeds the thickness of the section 9 or 9*a*. For example, the distance between the parallel axes of the two sets of pintles 8 can equal or approximate the combined thickness of the sections 9 and 9*a*, i.e., twice the thickness of the section 9 or 9*a* (it being assumed here that the sections 9 and 9*a* are substantially identical).

When the sections 9, 9*a* are caused or permitted to assume the second or inoperative positions which are shown in FIG. 6, the downwardly extending major portion of the mophead 6 (between the then neighboring outer portions 5 of the sections 9 and 9*a*) can be readily introduced into a relatively small vessel 10 which is indicated in FIG. 6 by broken lines and contains a supply of clean water or another suitable cleaning liquid. Once the mophead 6 is thoroughly or adequately washed (and, if necessary, rinsed), it can be introduced into a suitable wringer (not shown), e.g., a wringer of the type described and shown in U.S. Pat. No. 4,663,798 granted May 12, 1987 to Sacks et al. or in U.S. Pat. No. 4,704,763 granted Nov. 10, 1987 to Sacks et al. The sections 9, 9*a* of the carrier 2 are thereupon returned to the first or operative positions which are shown in FIGS. 1 and 5 and in which the freshly cleaned and at least partially dried mophead 6 is stretched to overlie the coplanar undersides of the two sections. The sections 9 and 9*a* are automatically locked when they reassume the positions which are shown in FIGS. 1 and 5.

The locking device 11 for the sections 9 and 9*a* of the carrier 2 is mounted at the upper side of the support 7 and remains operative to prevent pivoting of the sections 9, 9*a* about the axes of the respective sets of pintles 8 until and unless the operator decides to directly or indirectly operate an actuator 12 which is mounted at the upper side of the section 9*a* and then permits the sections 9, 9*a* to leave the positions which are shown in FIGS. 1 and 5. The improved mop 1 comprises a common locking device 11 for the two sections 9, 9*a* and a single actuator 12 for the locking device 11. The support 7 of the carrier 2 serves as a stop which abuts the adjacent portions of upper sides of the sections 9 and 9*a* to arrest such sections in their first or operative positions in which the locking device 11 is free to block any undesired pivotal movements of the sections 9, 9*a* toward the second or inoperative positions of FIG. 6.

Figure 2:
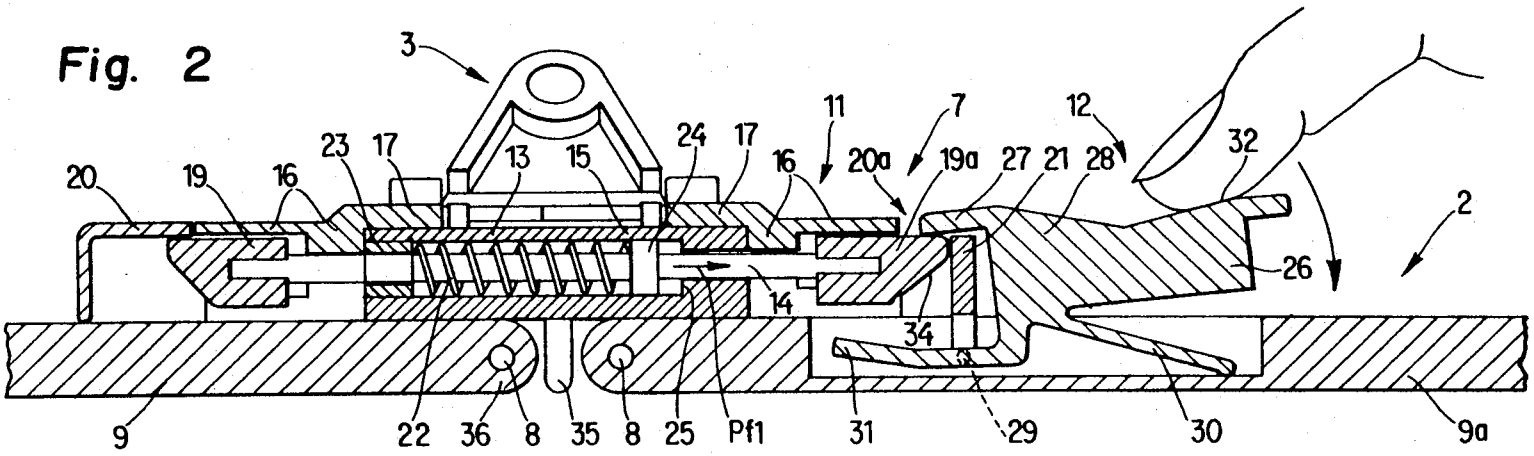
FIG. 2 is an enlarged fragmentary central longitudinal vertical sectional view of the cleaning implement, with the sections of the carrier shown in the first positions.
Figure 3:
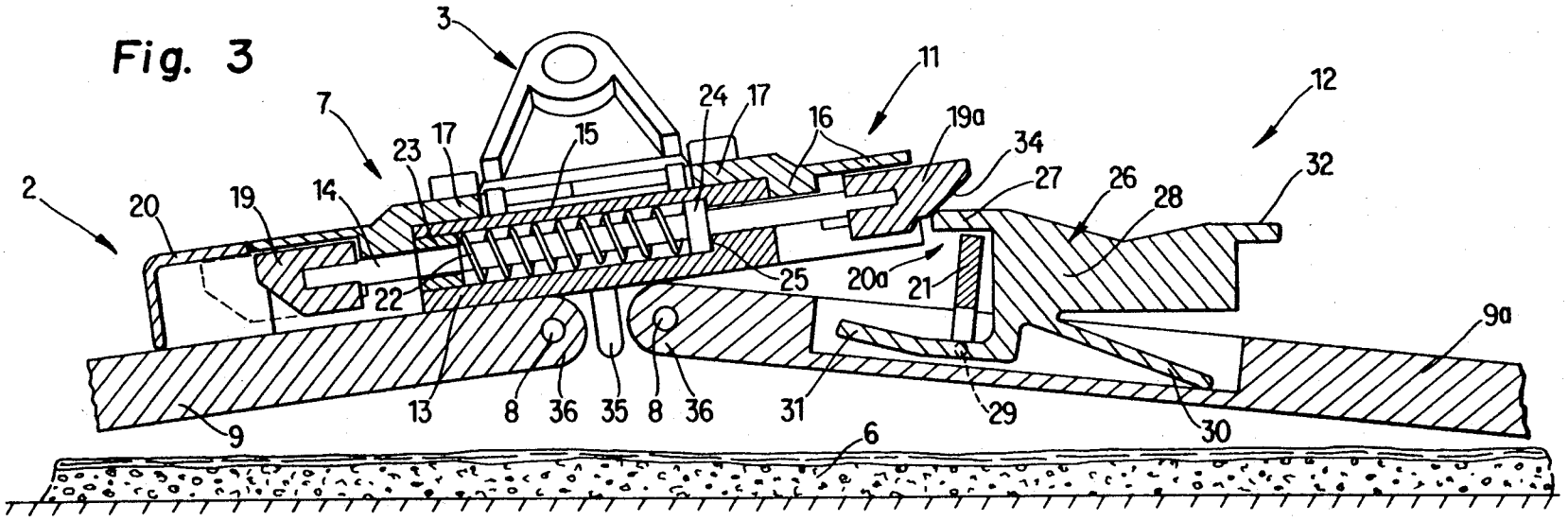
FIG. 3 is a similar fragmentary central longitudinal vertical sectional view, with one of the sections shown in an intermediate position.
Figure 4:
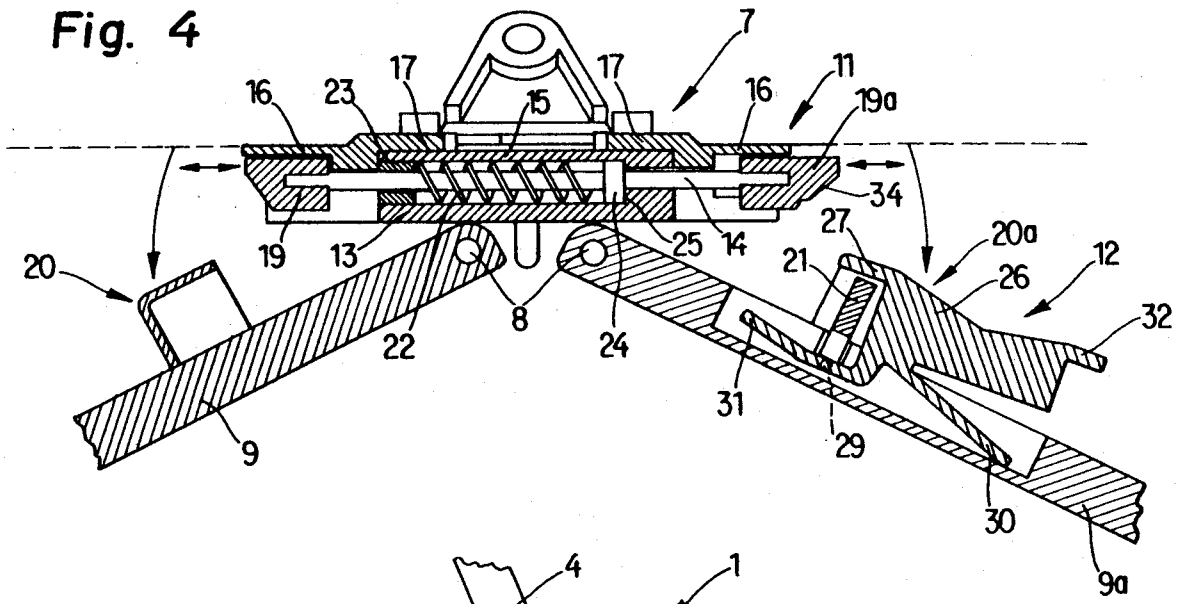
FIG. 4 is a similar fragmentary central longitudinal vertical sectional view but showing both sections in their intermediate positions.

The locking device 11 comprises an elongated locking bolt 14 which is reciprocable in a sleeve- or trough-shaped guide 13 of the support 7 and extends transversely of the pivot axes of the sections 9 and 9*a*. The details of the locking bolt 14, guide 13 and actuator 12 are shown in FIGS. 2, 3 and 4. FIG. 2 shows the locking bolt 14 in the operative or arresting position in which the sections 9, 9*a* of the carrier 2 are held in the first positions; FIG. 2 shows the locking bolt 14 in a position of disengagement from the section 9*a*; and FIG. 4 shows the locking bolt 14 in a position of disengagement from the sections 9 and 9*a*. The guide 13 performs an additional important function, namely to define a pivot axis for the handle 4. Such pivot axis is normal to the pivot axes for the sections 9 and 9*a*. Thus, the central portion 15 of the guide 13 can be said to form part of the coupling means 3 for the handle 4.

The guide 13 extends between two raised bearing portions 16 which are integral with and are disposed at the lateral edges of the support 7 (see particularly FIG. 1). The support 7 can be said to resemble a plate and has bearing members 17 for the guide 13. The bearing members 17 are open from below (see FIG. 7) and surround portions of the guide 13. In the embodiment which is shown in the drawing, the bearing members 17 and the raised bearing portions 16 are integral parts of the support 7 and can be made of a suitable metallic or plastic material. The guide 13 is inserted into the bearing members 17 from below at the underside of the support 7 which is exposed (open) between the sections 9, 9*a* as well as between the inner portions of these sections (the inner portions are connected to the respective sets of pintles 8). Once the guide 13 is properly installed in the bearing members 17 of the support 7, it is held in such position by a retaining pin or post 18. In addition, the guide 13 is held in the operative position by the inner portions of the sections 9 and 9*a* as soon as these sections are pivotally connected to the support by the pintles 8.

The feature that the support 7 is open from below is desirable and advantageous because this reduces the likelihood of accumulation of large quantities of impurities at the underside and renders it possible to flush out the collected contaminants in the body of liquid in the vessel 10 (e.g., a bucket) or by a spray of water or the like. In fact, the underside of the support 7 is cleaned and rinsed in a fully automatic way in response to each insertion of the collapsed carrier 2 into a body of cleaning liquid. The aforedescribed mode of installing the guide 13 in the support 7 has been found to contribute to simplification of assembly of the entire mop 1 and to permit completion of the assembly within a short interval of time.

FIG. 2 shows the locking bolt 14 in the operative position in which its end portions 19 and 19*a* respectively extend into hood-shaped sockets 20 and 20*a*. The socket 20 is provided at the upper side of the section 9, and the socket 9*a* is located at the upper side of the section 9*a* but is provided on the actuator 12. The sockets 20 and 20*a* are spaced apart from the respective pivot axes (i.e., from the respective sets of pintles 8) for the sections 9 and 9*a*. A coil spring 22 serves as a means for biasing the locking bolt 14 to the inoperative position of FIG. 3 (arrow Pf1 in FIG. 2); this spring reacts against a ring 23 in the guide 13 and bears against a collar 24 of the bolt 14 to urge the collar 24 against an internal shoulder 25 of the guide 13. The shoulder 25 cooperates with the collar 24 to constitute a means for blocking the movement of the locking bolt 14 beyond the inoperative position of FIG. 3 under the action of the spring 22.

The reference character 21 denotes a stop which is provided on the section 9*a* and serves to locate the locking bolt 14 in the operative position of FIG. 2, i.e., to prevent the spring 22 from dissipating energy and propelling the bolt 14 to the inoperative position of FIG. 3. The stop 21 can be engaged by the end portion 19*a* of the locking bolt 14.

When the actuator 12 has caused or permitted the locking bolt 14 to leave the operative position of FIG. 2, the end portion 19 is withdrawn from the socket 20 into the adjacent bearing portion 16 of the support 7 (FIG. 3). The end portion 19*a* is then located externally of and overlies the socket 20*a* on the actuator 12. Furthermore, the end portion 19*a* is located externally of the respective bearing portion 16 of the support 7.

The actuator 12 is a pivotable pedal which includes a holder 26 in the form of a lever. The holder 26 has a claw 27 which forms part of or constitutes the socket 20*a* and normally overlies the stop 21. The holder 26 further includes an extension or arm 28 which is adjacent the claw 27 and is provided with a platform 32 adapted to be depressed by a finger (see FIG. 2), by an article of footwear or by any other object whereby the holder 26 pivots about the axis of a hinge 29 which is provided in a recess in the upper side of the section 9*a* and defines a pivot axis extending in parallelism with the axes of the pintles 8 of hinges for the sections 9 and 9*a*. The hinge 29 is spaced apart from the claw 27 and is provided on a leaf spring 31 which is an integral part of the holder 26 and serves as a means for pivoting the section 9*a* from the operative position of FIG. 2 when the platform 32 is depressed to pivot the actuator 12 in a clockwise direction (as seen in FIG. 2). The leaf spring 31 then urges the end portion 19*a* of the locking bolt 14 upwardly and causes it to slide along and to rise above the stop 21 as soon as the claw 27 (socket 20*a*) is moved out of the way in response to pivoting of the actuator 12. Another integral leaf spring 30 of the holder 26 serves as a means for yieldably urging the actuator 12 to the position of FIG. 2 in which the claw 27 can overlie the end portion 19*a* of the locking bolt 14 while the latter is maintained in the operative position (in which the end portion 19*a* abuts the stop 21 and the collar 24 is spaced apart form the shoulder 25). The integral leaf spring 30 and/or 31 of the holder 26 can be replaced with a separately produced spring without departing from the spirit of the invention. The leaf spring 31 can be designed to bear against the underside of adjacent portion of the support 7 when the actuator 12 is pivoted in a clockwise direction (starting from the angular position of FIG. 2).

FIG. 2 shows that the platform 32 of the arm or extension 28 of the holder 26 is about to be depressed by a finger. At such time, the carrier 2 is or can be lifted off the floor to provide room for pivoting of the section 9*a* from the operative or first position of FIG. 2 to the intermediate position of FIG. 3 in which the claw 27 (socket 20*a*) is spaced apart from the tip of the end portion 19*a* and abuts a cam face 34 at the underside of the end portion 19*a*. The cam face 34 serves as or forms part of a means for moving the locking bolt 14 from the inoperative position back toward the operative position of FIG. 2. The platform 32 can be depressed by a foot (and more particularly by an article of footwear) or by any other object which is available to pivot the actuator 12 from the position of FIG. 2. The platform 32 is preferably located at least slightly to the right of the socket 20*a* (claw 27) so that it can be conveniently engaged by an article of footwear while the person in charge is holding on to the handle 4 to maintain the carrier 2 in a position at a level at least slightly above the floor.

However, it is equally possible to start the pivotal movement of the section 9*a* from the operative position of FIG. 1 without lifting the carrier 2 above the floor. Thus, the operator steps onto the platform 32 of the lever 28 while the sections 9 and 9*a* are locked in the operative positions of FIG. 2. The depressed platform 32 causes the claw 27 to move away from the end portion 19*a* of the locking bolt 14 and the leaf spring 31 causes the section 9*a* to pivot clockwise relative to the section 9 and support 7. This suffices to move the end portion 19*a* of the bolt 14 along the adjacent side of and above the stop 21 on the section 9*a*. The spring 22 is free to expand and to propel the collar 24 of the locking bolt 14 against the shoulder 25 so that the end portion 19 is withdrawn from the socket 20 and the section 9 is free to pivot relative to the support 7 (see FIG. 4).

Initial pivoting of the section 9*a* from the operative position of FIG. 2 can be assisted by the operator who maintains the foot on the platform 32 and, at the same time, pulls the handle 4 so that the leaf spring 31 is even more capable of pivoting the section 9*a* relative to the support 7 in order to separate the claw 27 from the end portion 19*a* and to promote the movement of the end portion 19*a* along the left-hand side of and upwardly beyond the stop 21. The simplest way to release the section 9*a* for movement from the operative position is to slightly raise the carrier 2 above the floor and to thereupon step on the platform 32 while pulling the handle 4 upwardly.

Once the locking bolt 14 is released for movement from the operative position of FIG. 2, the sections 9, 9*a* tend to pivot by gravity toward and to the second or inoperative positions which are shown in FIG. 6. At such time, only the flap-shaped flexible end portions or extensions 33 (FIG. 5) of the mophead 6 continue to contact the respective sections 9, 9*a* whereas the entire median portion of the mophead forms an elongated loop (FIG. 6) which can be immersed into a body of cleaning liquid in the vessel 10 of FIG. 6 or in any other suitable container. When the cleaning (and, if necessary, a following rinsing) operation is completed, the mophead 6 is or can be acted upon by a wringer prior to moving the sections 9 and 9a of the carrier 2 back to the operative positions of FIG. 1, 2 or 5.

In order to return the sections 9, 9a to their operative positions, the outer portions 5 of such sections are caused to (indirectly) abut the floor and the handle 4 is thereupon pressed downwardly so that the outer portions 5 of the sections move apart as a result of pivotal movement of the inner portions of the sections 9, 9a about the axes of the respective pintles 8. Pivoting of the sections 9 and 9a away from their inoperative positions which are shown in FIG. 6 can be promoted by rapidly turning the handle 4 about its axis so that the outer portions 5 of the sections tend to move away from each other under the action of centrifugal force before the outer portions 5 are caused to contact the ground and the handle 4 is pushed downwardly to ensure that the pivotal movements of the sections continue until the end portions of the bolt 14 are again free to penetrate into the sockets 20 and 20a. At least some pivoting of the sections 9 and 9a under the action of centrifugal force (as a result of turning of the handle 4 about its axis) is assisted if the two sets of pintles 8 are not immediately adjacent each other. As mentioned above, the distance between the axes of the two sets of pintles 8 can exceed the thickness of the section 9 or 9a and can equal or approximate the combined thickness of the two sections.

Pivoting of the section 9 to its operative position is terminated by the support 7 because the latter abuts the adjacent upper side of the section 9 when this section reaches the position of FIG. 2 or 3. Pivoting of the section 9a toward the operative position is terminated when the claw 27 overlies the adjacent and portion 19a of the locking bolt 14. During movement toward such position, the claw 27 slides along the cam face 34 and thereby pushes the bolt 14 to introduce the end portion 19 into the socket 20.

FIG. 3 shows that the end portion 19 can enter the adjacent socket 20 (to thereby lock the section 9 in the operative position) before the section 9a reassumes the operative position. In fact, the claw 27 can push the locking bolt 14 beyond the operative position which is shown in FIG. 2 in that the end portion 19 penetrates into the socket 20 to assume the left-hand end position which is indicated in FIG. 3 by broken lines. The spring 22 is then free to dissipate some energy as soon as the claw 27 advances beyond the end portion 20a so that bolt 14 is pushed to the right and assumes the operative position of FIG. 2 as soon as the end portion 19a engages the adjacent side of the stop 21 and is overlapped by the claw 27.

It will be noted that return movement of the sections 9 and 9a to the operative positions of FIG. 2 does not necessitate any pivoting and/or other manipulation of the actuator 12. All that is necessary is to cause the sections 9, 9a to move their outer portions 5 away from each other under the action of centrifugal force and/or mechanically by causing the outer portions 5 to bear against the floor. The bolt 14 is automatically returned to the operative position of FIG. 2 as soon as the pivoting of the sections 9, 9a into or close to a common plane is completed.

Figure 7:
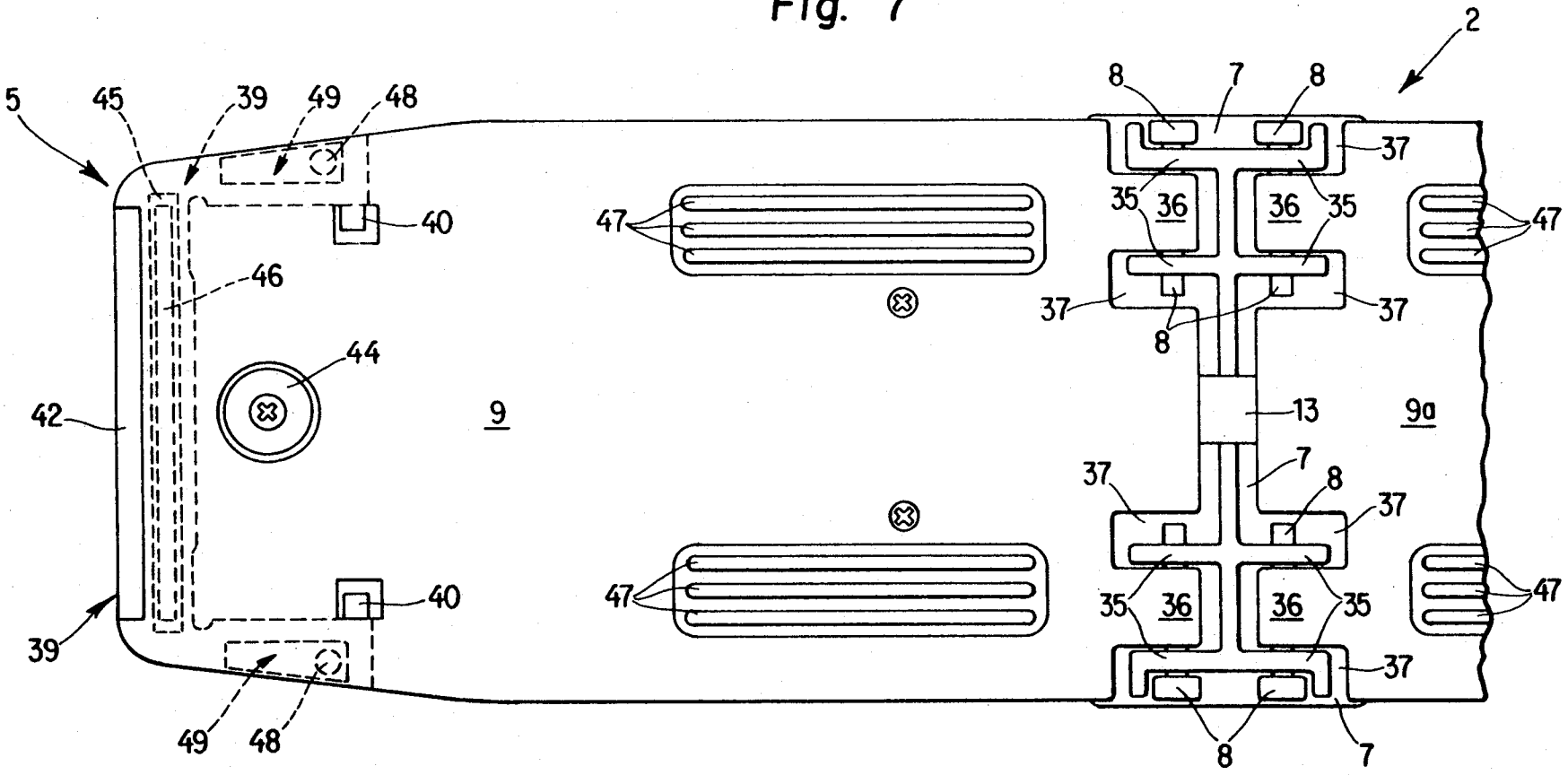
FIG. 7 is a fragmentary bottom plan view of the cleaning implement, with the mophead omitted.

FIG. 7 shows a portion of the underside of the erected carrier 2, with the mophead 6 omitted. It will be noted that the hinges which pivotally connect the inner portions of the sections 9, 9a to the support 7 comprise two sets of coaxial pintles 8. Each pintle 8 extends through a rib 35 of the support 7 and into the adjacent leaf 36 forming part of the inner portion of the respective section 9 or 9a. The leaves 36 alternate with recesses 37 in the inner portions of the sections 9 and 9a.

The mophead 6 is elongated and the flap-shaped end portions 33 (hereinafter flaps) are provided at its longitudinal ends. Each of these flaps can be separably connected to the outer portion 5 of the respective section 9, 9a by a connecting device 38 having a substantially U-shaped pivotable yoke 39 which is movable between a retaining position (note the right-hand yoke 39 of FIG. 1) and a releasing position (note the left-hand yoke 39 of FIG. 1). Each yoke 39 comprises an elongated web 42 which is substantially parallel with the axes of the pintles 8 and two legs 50 having inwardly extending coaxial stubs 40 (FIG. 7) turnable in suitable bearings of the respective section 9 or 9a. The upper sides of outer portions 5 of the sections 9 and 9a are formed with U-shaped marginal recesses 41 which can receive the respective yokes 39 in the retaining positions of the yokes. The webs 42 of the yokes 39 can be releasably arrested in the retaining positions by rotary knobs 44 which are mounted at the upper sides of the respective sections.

Each web 42 is formed with a longitudinally extending recess 45, e.g., a recess in the form of a through slot, which can receive a complementary elongated projection (e.g., a rib) 46 at the upper side of the respective outer portion 5. Each flap 33 of the mophead 6 is caused to overlie the respective projection 46 and extends along the inner side 42a of the respective web 42 before the yoke 39 is pivoted to the retaining position so that the flaps 33 assume an undulate shape and are reliably but readily separably connected to the respective outer portions 5. Additional connecting or retaining action can be achieved by causing the rotary knobs 44 to overlie portions of the flaps 33 (see FIG. 5). The inner sides 42a of the webs 42 cooperate with and can frictionally engage elongated shoulders 43 in the respective U-shaped recesses 41 when the yokes are pivoted to their retaining positions in the absence of flaps 33 between such shoulders and the respective inner sides. This ensures that the webs 42 of the yokes 39 frictionally engage and hold the flaps 33 in cooperation with the adjacent shoulders 43 when the mophead 6 is properly connected to the carrier 2. The just described mode of separably connecting the flaps 33 to the respective outer portions 5 by means of the connecting devices 38 ensures the establishment of a reliable connecting action even if the mophead 6 is subjected to a pronounced pulling or detaching force, e.g., in the course of the wringing operation. The width of the flaps 33 may but need not match the length of the shoulders 43, inner sides 42a and slots 45. Reliable clamping of the flaps 33 (each of which is provided with several undulations when the respective yoke 39 is received in its recess 41) is desirable and advantageous because the median or major portion of the mophead 6 is not positively connected to the adjacent portions of the sections 9 and 9a. The tensional stress upon the properly connected mophead 6 is preferably sufficient to prevent any wrinkling and/or other undesirable movements of the median portion of the mophead when the mop 1 is in actual use.

The elongated unevennesses or ribs 47 at the undersides of the sections 9 and 9a also contribute to prevention of undesirable movements of median portion of the mophead 6 relative to the carrier 2 when the sections 9 and 9a are maintained in the first or operative positions which are shown in FIGS. 1, 2, 5 and 7. The ribs 47 exhibit the advantage that they oppose undesirable movements of median portion of the mophead 6 relative to the undersides of the sections 9 and 9a in the longitudinal direction of pivot axes for the sections but do not establish a positive (e.g., form-locking) connection with the carrier 2. Therefore, the median portion of the mophead 6 can assume the position of FIG. 6 by gravity as soon as the movement of the sections 9, 9a to their inoperative positions is completed. Such looping of the median portion of the mophead 6 can take place without any assistance from the operator.

FIG. 7 further shows one presently preferred mode of rotatably connecting the knobs 44 to the outer portions 5 of the respective sections of the carrier 2.

In order to prevent deformation of the yokes 39 when a mophead 6 having relatively thin flaps 33 is replaced with a mophead having thicker flaps, the upper sides of outer portions 5 of the sections 9, 9a are preferably provided with male positioning members 48 which can enter female positioning members 49 in the legs 50 when the yokes 39 are pivoted to enter the respective recesses 41. This prevents the legs 50 of a yoke 39 from moving apart during pivoting of the yoke to its retaining position. The positions of the male and female positioning elements 48, 49 can be reversed, i.e., the male positioning elements can be provided on the legs 50 to enter female positioning elements at the upper sides of outer portions 5 of the respective sections 9 and 9a.

An important advantage of the improved mop 1 is that a single locking device 11 (i.e., a device having a single locking bolt 14) suffices to maintain the sections 9, 9a of the carrier 2 in their operative positions. Another important advantage of the improved mop is that a single actuator 12 suffices to actuate the locking device 11, i.e., to permit the sections 9 and 9a to move toward their inoperative positions. Furthermore, the locking bolt 14 automatically assumes the operative or locking position as soon as the sections 9, 9a return to the positions of FIG. 2 provided, of course, that the actuator 12 is not caused to leave the normal or starting position of FIG. 2. It has been found that the locking device 11 can maintain the sections 9, 9a in the operative positions even if the sections are subjected to the action of a large force which tends to move them toward the positions of FIG. 6. Such movement is possible only upon pivoting of the holder 26 of the actuator 12 about the axis of the hinge 29. Reliable retention of the sections 9, 9a in their operative positions is of considerable advantage, particularly when the mop 1 is in actual use, because the operator need not be concerned with the possibility of accidentally releasing the locking device 11 at an inopportune time, e.g., when the carrier 2 accidentally strikes a stair or another protuberance of or an obstruction on the floor. The operator need not search for a particular actuator 12 because only one such actuator is needed and provided and because the only actuator is always within sight of the person holding the handle 4.

The locking device 11, the actuator 12 and the sockets 20, 20a for the end portions 19, 19a of the locking bolt 14 occupy space (at the upper side of the carrier 2) which is readily available and need not be used for other purposes.

The pivot axis which is defined by the guide 13 for the handle 4 is preferably closely adjacent the carrier 2. This is desirable and advantageous because the carrier 2 and the mophead 6 are less likely to be accidentally tilted while the mop 1 is in use. Accidental tilting of the carrier in a conventional cleaning implement is likely to take p to be cleaned offers pronounced resistance to sliding movement of the mophead therealong and/or during mopping of thresholds.

The spring 22 ensures that the locking bolt 14 automatically assumes its inoperative position when the actuator 12 permits it, and the shoulder 25 cooperates with the collar 24 to ensure that the bolt 14 cannot be propelled (by the spring 22) beyond its inoperative position (shown in FIGS. 3 and 4). Stoppage of the locking bolt 14 in a predetermined inoperative position is desirable and advantageous because this enables the claw 27 to cooperate with the cam face 34 in automatically moving the bolt 14 back toward the operative position when the sections 9 and 9a are caused to pivot from the positions of FIG. 6 toward the positions of FIG. 1.

The leaf spring 30 ensures that the actuator 12 invariably tends to assume its starting position and to automatically prevent the locking bolt 14 from leaving the operative position as soon as the claw 27 completes (in cooperation with the cam face 34) the return movement of the bolt 14 to the end position of FIG. 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A cleaning implement comprising a substantially plate-like mophead carrier including first and second sections each having an upper side and an underside, said sections being pivotable relative to each other between first positions in which said undersides are substantially coplanar and second positions in which said undersides confront each other; a handle; means for movably coupling said handle to said carrier at the upper sides of said sections, said carrier further comprising a support for said coupling means and hinges pivotally connecting said sections to said support, said support overlying portions of said upper sides in the first positions of said sections and said hinges defining substantially parallel pivot axes for said sections; means for releasably locking said sections in said first positions, including a locking device which is actuatable to release said sections for movement from said first positions and a single actuator for said locking device, said locking device comprising a bolt which is reciprocable along a predetermined path substantially transversely of said pivot axes and has first and second end portions, and first and second sockets provided at the upper sides of the respective sections and spaced apart from said hinges, said bolt being movable between an operative position in which its end portions are received in the respective sockets and an inoperative position in which at least one of said end portions is withdrawn from the respective socket, said locking device further comprising means for biasing said locking bolt to said inoperative position and means for blocking the movement of said bolt beyond said inoperative position under the action of said biasing means; said actuator including a holder for one of said sockets and said holder being movable relative to the respective section between a retaining position in which said one socket is free to receive the respective end portion of said locking bolt and a releasing position in which said one socket is outside of the path of movement of the respective end portion; and means for moving said locking bolt from said inoperative position in response to pivoting of the section for said holder to said first position.

2. The implement of claim 1, wherein said moving means comprises a cam face confronting the upper side of the section for said holder and being provided on that end portion which is receivable in said one socket.

3. The implement of claim 2, wherein said holder includes a claw forming part of said one socket, an arm adjacent said claw and means for pivotally securing said holder to the respective section.

4. The implement of claim 3, where in said claw engages said cam face to move said locking bolt from said inoperative position in response to pivoting of the section for said holder to said first position.

5. The implement of claim 3, wherein said claw is disposed between said one end portion and said arm and said securing means is spaced apart from said claw.

6. A cleaning implement comprising a substantially plate-like mophead carrier including first and second sections each having an upper side and an underside, said sections being pivotable relative to each other between first positions in which said undersides are substantially coplanar and second positions in which said undersides confront each other; a handle; means for movably coupling said handle to said carrier at the upper sides of said sections; and means for releasably locking said sections in said first positions, including a locking device which is actuatable to release said sections for movement from said first positions, and a single actuator for said locking device, said actuator comprising a pivotable pedal on one of said sections, means for pivotally securing said pedal to said one section so that the pedal is moveable between a retaining position in which said locking device locks said sections in the first positions and a releasing position in which said locking device is free to permit pivoting of said sections to second positions, and means for yieldably urging said pedal to said retaining position.

7. The implement of claim 6, wherein said carrier further comprises a support for said coupling means and hinges pivotally connecting said sections to said support, said locking device being mounted on said support and said support overlying portions of said upper sides in the first positions of said sections.

8. The implement of claim 7, wherein said hinges define substantially parallel pivot axes for said sections and said locking device comprises a bolt which is reciprocable along a predetermined path substantially transversely of said pivot axes and has first and second end portions, said locking device further comprising first and second sockets provided at the upper sides of the respective sections and spaced apart from said hinges, said bolt being movable between an operative position in which its end portions are received in the respective sockets and an inoperative position in which at least one of said end portions is withdrawn from the respective socket.

9. The implement of claim 8, wherein said support comprises a guide for said locking bolt.

10. The implement of claim 7, wherein said guide forms part of said coupling means.

11. The implement of claim 10, wherein said guide defines for said handle a pivot axis which is substantially normal to the pivot axes for said sections.

12. The implement of claim 8, wherein said sockets are at least closely adjacent said support in the first positions of said sections.

13. The implement of claim 8, wherein each of said sockets includes a hood which overlies the respective end portion in the first positions of said sections.

14. The implement of claim 8, wherein one of said sockets forms part of said actuator.

15. The implement of claim 6, wherein said pedal includes an arm with a platform which is depressible by a finger or by a foot.

16. The implement of claim 6, wherein said actuator further comprises means for pivoting said one section from said first position in response to pivoting of said pedal from said retaining to said releasing position.

17. The implement of claim 6, wherein each of said sections has a predetermined thickness and said carrier further comprises a support for said coupling means and hinges connecting said sections to said support for pivotal movement about two spaced-apart substantially parallel axes, said axes being spaced apart a distance greater than said predetermined thickness.

18. The implement of claim 17, wherein said distance is approximately twice said predetermined thickness.

19. The implement of claim 6, wherein said carrier further includes a support for said coupling means and said locking means, and hinges pivotally connecting said sections to said support, said support having an open underside affording access to said coupling means between said sections.

20. A cleaning implement comprising a substantially plate-like mophead carrier including first and second sections each having an upper side and an underside, said sections being pivotable relative to each other between first positions in which said undersides are substantially coplanar and second positions in which said undersides confront each other; a handle; means for movably coupling said handle to said carrier at the upper sides of said sections, said carrier further comprising a support for said coupling means and hinges pivotally connecting said sections to said support, said support overlying portions of said upper sides in the first positions of said sections and said hinges defining substantially parallel pivot axes for said sections; and means for releasably locking said sections in said first positions, including a locking device which is actuatable to release said sections for movement from said first positions and a single actuator for said locking device, said locking device comprising a bolt which is reciprocable along a predetermined path substantially transversely of said pivot axes and has first and second end portions, first and second sockets provided at the upper sides of the respective sections and spaced apart from said hinges, said bolt being movable between an operative position in which said end portions are received in the respective sockets and an inoperative position in which at least one of said end portions is withdrawn from the respective socket, means for biasing said bolt to said inoperative position, means for blocking the movement of said bolt beyond said inoperative position under the action of said biasing means, and means for locating said bolt in said operative position against the opposition of said biasing means.

21. The implement of claim 20, wherein said support comprises a guide for said locking bolt and at least one of said end portions extends beyond said guide in the inoperative position of said locking bolt.

22. A cleaning implement comprising a substantially plate-like mophead carrier including first and second sections each having an upper side and an underside, said sections being pivotable relative to each other between first positions in which said undersides are substantially coplanar and second positions in which said undersides confront each other; a handle; means for movably coupling said handle to said carrier at the upper sides of said sections, said carrier further comprising a support for said coupling means and hinges pivotally connecting said sections to said support, said support overlying portions of said upper sides in the first positions of said sections and said hinges defining substantially parallel pivot axes for said sections; means for releasably locking said sections in said first positions, including a locking device which is actuatable to release said sections for movement from said first positions and a single actuator for said locking device, said locking device comprising a bolt which is reciprocable along a predetermined path substantially transversely of said pivot axes and has first and second end portions, and first and second sockets provided at the upper sides of the respective sections and spaced apart from said hinges, said bolt being movable between an operative position in which said end portions are received in the respective sockets and an inoperative position in which at least one of said end portions is withdrawn from the respective socket, said actuator including a holder for one of said sockets and said holder being movable relative to the respective section between a retaining position in which said one socket is free to receive the respective end portion of said locking bolt and a releasing position in which said one socket is outside of the path of movement of the respective end portion; and means for yieldably urging said holder to said retaining position.

23. The implement of claim 8, wherein said actuator includes a holder for one of said sockets, said holder being movable relative to the respective section between a retaining position in which said one socket is free to receive the respective end portion of said locking bolt and a releasing position in which said one socket is outside of the path of movement of the respective end portion.

* * * * *